US008622167B2

(12) United States Patent
Nording et al.

(10) Patent No.: US 8,622,167 B2
(45) Date of Patent: Jan. 7, 2014

(54) COMPONENT FOR MOTOR VEHICLES AND METHOD FOR ITS PRODUCTION

(75) Inventors: Thomas Nording, Esslingen (DE); Thomas Tauscheck, Ostfildern (DE)

(73) Assignee: J. Eberspaecher GmbH & Co. KG, Esslingen (DE)

( * ) Notice: Subject to any disclaimer, the term of this patent is extended or adjusted under 35 U.S.C. 154(b) by 0 days.

(21) Appl. No.: 13/458,178

(22) Filed: Apr. 27, 2012

(65) Prior Publication Data

US 2012/0273296 A1 Nov. 1, 2012

(30) Foreign Application Priority Data

Apr. 28, 2011 (DE) ..... 10 2011 017 643

(51) Int. Cl.
*A47B 81/06* (2006.01)

(52) U.S. Cl.
USPC ..... 181/198; 181/243; 181/227; 181/228

(58) Field of Classification Search
USPC ..... 181/243, 227, 228, 198
See application file for complete search history.

(56) References Cited

U.S. PATENT DOCUMENTS

| | | | | |
|---|---|---|---|---|
| 1,995,542 | A * | 3/1935 | Haviland | 285/322 |
| 4,495,237 | A * | 1/1985 | Patterson | 428/178 |
| 4,570,747 | A * | 2/1986 | Ortyl | 181/243 |
| 7,434,658 | B2 * | 10/2008 | Staut | 181/271 |
| 7,650,964 | B2 * | 1/2010 | Spieth | 181/212 |
| 8,051,949 | B2 * | 11/2011 | Henke et al. | 181/251 |
| 2006/0251470 | A1 * | 11/2006 | Prause | 403/119 |

FOREIGN PATENT DOCUMENTS

| | | | |
|---|---|---|---|
| DE | 19539168 | A1 | 4/1997 |
| DE | 103 51 651 | A1 | 5/2004 |
| DE | 102006035578 | A1 | 1/2008 |
| DE | 102008004544 | B3 | 1/2009 |
| DE | 202008014465 | U1 | 4/2010 |
| EP | 1333164 | A1 | 8/2003 |
| EP | 1 657 414 | A1 | 9/2005 |
| JP | 2 280842 | A | 11/1990 |
| JP | 07-008518 | U | 2/1995 |
| JP | 9 291813 | A | 11/1997 |
| WO | WO 2004/056619 | A1 | 7/2004 |

* cited by examiner

*Primary Examiner* — Forrest M Phillips
(74) *Attorney, Agent, or Firm* — Reinhart Boerner Van Deuren P.C.

(57) ABSTRACT

The invention relates to a component (1) for motor vehicles, in particular in exhaust systems or in independent heaters, comprising a carrier (2), wherein the carrier (2) has a predefined structural stiffness and a plate (3) for increasing the predefined structural stiffness of at least a part of the carrier (2), wherein the plate (3) is fixed to the carrier (2) via at least one connection (4), wherein the plate (3) comprises at least one honeycomb structure (W).

The invention likewise relates to a method for producing a component (1) as well as a use.

15 Claims, 2 Drawing Sheets

COMPONENT FOR MOTOR VEHICLES AND METHOD FOR ITS PRODUCTION

CROSS-REFERENCE TO RELATED PATENT APPLICATIONS

This patent application claims priority to German Application No. 102011017643.8, filed Apr. 28, 2011, the entire teachings and disclosure of which are incorporated herein by reference thereto.

FIELD OF THE INVENTION

The invention relates to a component for motor vehicles, a method for the production of a component for motor vehicles and a use. Thus, the invention relates in particular to a vehicle component, preferably a silencer and to a heating device, such as for example an auxiliary heater or an independent heater.

BACKGROUND OF THE INVENTION

Components are used in a wide variety of technical areas, for example in house construction, in motor vehicles or the like. In order to adapt components to specific requirements, these are frequently reinforced in order to be able to withstand greater loads or to make possible a longer lifespan of the component.

Thus, for example in the area of house construction, a component has become known from DE 20 2008 014 465 U1, which is provided with a reinforcing layer of hydraulically set material of a cement mortar or concrete mixture, wherein the reinforcing layer is formed of a reinforcing mat, an outer skin and cement mortar or concrete mixture introduced in between.

From DE 10 2006 035 578 A1 a further method for producing a fibre-reinforced component has become known. Here, a fibre reinforcing structure is initially produced which is then embedded in the carrier material of the component during the production of the component.

SUMMARY OF THE INVENTION

The present invention deals with the problem of simply and cost-effectively improving a component for a motor vehicle with respect to its stiffness.

According to the invention, this problem is solved through the subjects of the independent claims:

A component for motor vehicles, in particular in exhaust systems or in independent heaters is defined comprising a carrier, wherein the carrier has a predefined structural stiffness, and a plate for increasing the predetermined structural stiffness of at least a part of the carrier, wherein the plate is fixed on the carrier via at least one connection, wherein the plate at least partially comprises a honeycomb structure.

A method for the production of a component comprising the step of fixing the plate on at least one part of the carrier. It is clear that the carrier and the plate have to be produced beforehand, wherein during the production of the plate the latter is at least partially provided with a honeycomb structure.

A use of a component in a motor vehicle is defined, in particular in an exhaust line and/or in an independent heater of the motor vehicle.

By arranging a plate with at least partial honeycomb structure, an increase of the stiffness of the carrier and thus of the component at least in the region of the plate is achieved. The plate which is at least partially of a honeycomb shape can in this case be fixed on the carrier of the component in a simple and cost-effective manner. At the same time, the lifespan of the component as a whole is improved because of this, since through the increased stiffness, cracks or material fatigues of the material of the carrier are reduced. Since the plate which is designed at least partially in a honeycomb shape can absorb a part of the loads acting on the component, the wall thickness of the carrier can be reduced for example in this manner, so that less material for the production of the carrier is required. Finally, the at least partially honeycomb-shaped plate can also be flexibly employed and can be fixed on both flat, areal and/or on curved surfaces of the carrier. Practically, the carrier is configured areally and in particular flat in the region in which the plate is arranged, which simplifies the arrangement of the plate which can be practically configured complementarily thereto, that is in particular likewise flat.

A honeycomb structure of the plate in this case can in particular comprise triangular, quadrangular, hexagonal, octagonal and/or dodecagonal honeycombs. In addition to this, further, preferentially symmetrical polygons as honeycombs are also conceivable, for example decagonal or the like. The honeycomb structure can be designed differently in different regions of the plate, for example a hexagonal honeycomb structure can be arranged in a region, in another region, because of a different expected loading, dodecagonal honeycombs can be arranged for example. The honeycomb structure in this case can be stamped onto a plate for example by means of stamping technology. It is also possible, in addition, to assemble the plate from individual elements and to arrange the individual elements in a honeycomb structure.

Advantageous embodiments are the subject of the dependent claims.

With an advantageous further development of the solution according to the invention, the plate is designed in multiple layers. In this manner, the stiffness of the plate and thus of the component is substantially increased, since the plate can have different layers of varying materials and thus also varying stiffness. At the same time, the lifespan of the plate as a whole increases also, since for example the outermost layer can be designed as protective layer for a certain application of the component.

Advantageous is an embodiment, wherein the carrier comprises at least one opening for passing through and exhaust pipe, wherein the plate is fixed on the carrier spaced from the at least one opening. In so far as such an exhaust gas conducting exhaust pipe in the installation state is fastened to the carrier, vibrations, during the operation of the exhaust system or the heater in vehicle applications can be introduced into the carrier via the pipe, which with a thin wall thickness of the carrier excite the latter to vibrations in a region spaced from the opening, which can be radiated to the surroundings as sound waves. By fastening the plate in this vibration-prone region, the plate in this region can be stiffened, which significantly reduces the vibration excitation tendency.

Advantageously it can be provided that the carrier comprises an edge enclosing the respective opening and standing away from the carrier in a projecting manner. On this edge, the respective exhaust pipe can be supported and—if required—also fastened. Preferentially, the edge stands away from the carrier in a side facing away from the plate.

With a further advantageous further development, the connection is designed non-positively and/or materially joined. In this manner it is ensured that the plate is reliably connected to the component and forces, which act on the component and its carrier, i.e. vibrations for example, are reliably transmitted at least partially onto the plate when the component is arranged in an exhaust line of a motor vehicle. This reduces vibrations of the component itself.

With a further advantageous further development the invention is designed as glued, soldered, welded, riveted, vulcanised and/or screwed connection.

For forming the honeycomb structure, the plate can be embodied as humped plate. Such a humped plate is characterized in that a plurality of humps are moulded out of a baseplate, which in particular is flat, for example by means of deep-drawing or by means of high-pressure forming, which humps stand out of the baseplate on a front side and at the same time create hollow spaces complementary thereto at the back of the baseplate. These hollow spaces then form the honeycombs of the honeycomb structure. The individual humps can preferably have areal, flat face ends and have a cone-shaped or pyramid-shaped shell. Insofar, the face ends of the honeycomb-shaped structure are connected to the baseplate via the respective shell. These shells in this case are arranged at an angle between 0 degrees and less than 90 degrees perpendicularly to a surface of the carrier, in particular, this angle amounts to 45 degrees. A further part of the honeycomb-shaped structure bears directly substantially areally against the carrier in a substantially areal way and is connected in a materially joined manner to the carrier by way of spot welds. Depending on the arrangement of the humped plate, either the face ends of the humps directly bear against the carrier and the baseplate is spaced there from or the baseplate directly bears against the carrier and the face ends of the humps are spaced there from.

Practically, the plate can be configured as composite plate which is assembled of a plurality of individual plates. Particularly advantageous in this case is the use of a humped composite plate which is assembled of at least two humped plates. This is practically carried out so that the humps of the first humped plate with their face ends areally bear against the baseplate of the second humped plate and are fastened thereto if required, namely on its front side, in each case between adjacent humps of the second hump plate. Conversely, the humps of the second hump plate simultaneously come to bear with their face ends against the front side of the baseplate of the first humped plate where they can be fastened. Because of this, a particularly stiff honeycomb structure is created. In order to further increase the stiffness of the honeycomb structure, the humps can be optionally dimensioned and spaced from one another that the humps of the first humped plate come to bear via their shells against the humps of the second humped plate and because of this make possible an intensive support in the shearing direction. Such a humped composite plate is known for example from DE 10 2008 004 544 B3.

With an advantageous further development of the method, the plate is connected to the carrier in a non-positively and/or materially joined manner. In this manner, it is ensured that the plate is reliably connected to the component and forces, which act on the component and its carrier, i.e. for example vibrations when the component is arranged in an exhaust line of a motor vehicle, are reliably transmitted at least partially onto the plate, in this way reducing vibrations of the component itself.

With a further advantageous further development of the method the plate is glued, soldered, welded, riveted, vulcanised and/or screwed to the carrier. This makes possible a simple, cost-effective and reliable connection of the plate to the carrier. Here it is obviously possible to combine a plurality of the aforementioned features for improving the connection of plate and carrier.

Further important features and advantages of the invention are obtained from the subclaims, from the drawings and the associated Figure description by means of the drawings.

It is to be understood that the features mentioned above and still to be explained in the following cannot only be used in the respective combination stated but also in other combinations or by themselves without leaving the scope of the invention.

BRIEF DESCRIPTION OF THE DRAWINGS

Preferred exemplary embodiments of the invention are shown in the drawing and will be explained in more detail in the following description, wherein same reference characters refer to same or similar of functionally same components.

Here it shows in each case schematically

Figure 1:
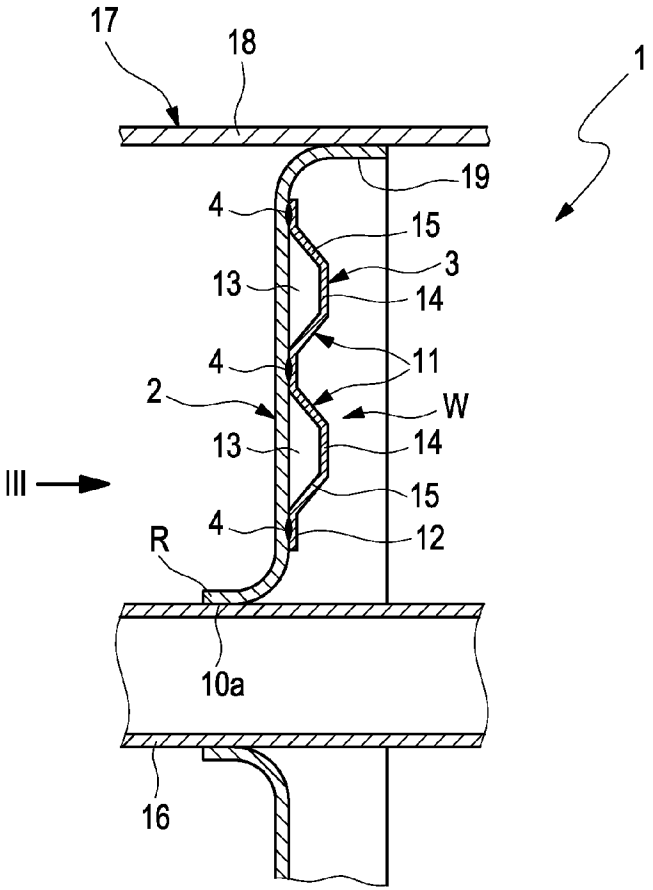
FIG. 1 a cross section of a component according to the invention in the manner of a silencer in a first embodiment.

According to FIG. 1, reference number 1 describes a component according to the invention, which is embodied in the manner of a silencer here. The component 1 comprises a carrier 2, which can form a part of a housing 17 of the component 1 or can be arranged in the interior of the housing 17 of the component 1. In the lower region, the carrier 2 according to FIG. 1 has a substantially circular opening 10*a*, which has a projecting edge R. An exhaust pipe 16 is passed through this opening 10*a*. The exhaust pipe 16 can form a sliding fit with the edge R. Alternatively the exhaust pipe 16 can be fastened to the edge R, for example by means of a gas-tight weld seam. In the upper region above the edge R the carrier 2 substantially extends perpendicularly upwards in the sheet plane. On the side of the carrier 2 facing away from the edge R and which for example faces an inner side of the component 1, the carrier 2 comprises an areal and in particular flat region in the upper region, in which a plate 3 is arranged on the carrier 2. The plate 3 has a honeycomb-shaped structure W, i.e. a honeycomb structure W and is designed in particular according to FIG. 1 in such a manner that a part of the honeycomb-shaped structure W is arranged spaced from the carrier 2.

For forming the honeycomb structure W, the plate 3 can be configured as humped plate, which in the following is likewise described by 3. Such a humped plate 3 is characterized in that a plurality of humps 11 are moulded out of a particularly flat baseplate 12, e.g. by means of deep-drawing or by means of high-pressure forming, which stand out from the baseplate 12 on a front side (in FIG. 1 on the right) and at the same time create hollow spaces 13 complementary thereto at the back (in FIG. 1 on the left) of the baseplate 12. These hollow spaces 13 then form the honeycombs of the honeycomb structure W, which in the following can also be described by 13. The individual humps 11 can preferentially comprise areal, flat face ends 14 and comprise a cone-shaped or pyramid-shaped shell 15. Insofar, the face ends 14 of the honeycomb-shaped structure W are connected to the baseplate 12 via the respective shell 15. These shells 15 in this case are arranged at an angle between 0 degrees and less than 90 degrees perpendicularly to a surface of the carrier 2, in FIG. 1 the angle amounts to 45 degrees. A further part of the honeycomb-shaped structure W directly bears against the carrier 2 in a substantially areal manner and is connected in a materially joint manner to the carrier 2 via spot welds 4. Depending on the arrangement of the humped plate 3, either the face ends 14 of the humps 11 bear directly against the carrier 2 and the baseplate 12 is spaced there from or, as in FIG. 1, the baseplate 12 bears directly against the carrier 2 and the face ends 14 of the humps 11 are spaced there from.

Figure 2:
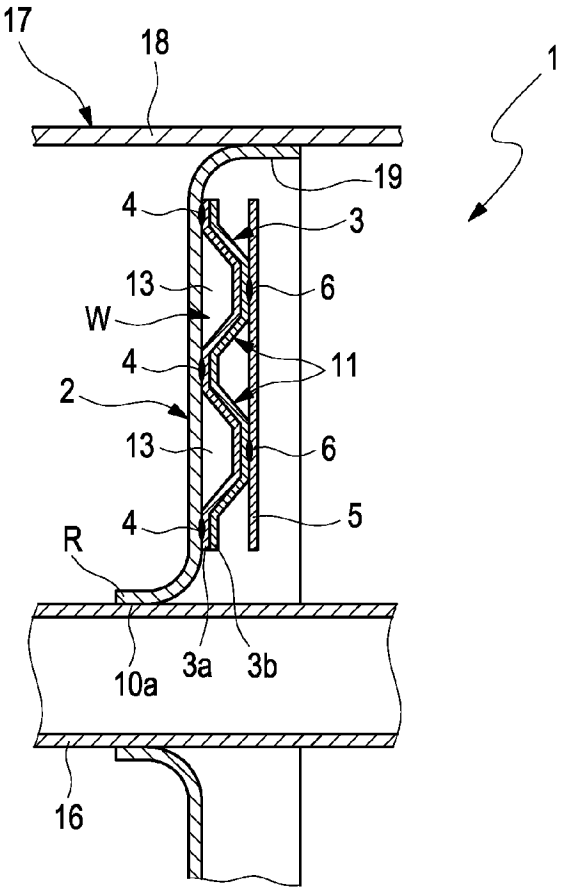
FIG. 2 a cross section of a component according to the invention in the manner of a silencer in a second embodiment.

FIG. 2 substantially shows a component 1 according to FIG. 1. In contrast with FIG. 1, the plate 3 according to FIG. 2 is designed in two layers having two layers 3*a*, 3*b*. Three or more layers can also be arranged. The layers 3*a*, 3*b* in this case can entirely or partially consist of same or preferentially varying material. The plate 3 in turn because of its honeycomb-shaped structure W comprises regions which substantially bear areally against the carrier 2 and regions which are spaced from the carrier 2.

To further increase the stiffness of the component 1 and the plate 3 of honeycomb-shaped design, a further plate 5 in particular of areal design can be arranged in the regions spaced from the carrier 2 on the side of the plate 3 facing away from the carrier 2. This plate 5 is fixed to the plate 3 of honeycomb-shaped design via a further connection 6, for example a welded connection. The plate 5 is substantially arranged parallel to the region of the carrier 2 on which the plate 3 is fixed.

The further plate 5 can likewise have a honeycomb structure W, wherein the honeycombs stand out from this plate 5 in the direction of the other plate 3 and between the honeycombs of the other plate 3, contact the other plate 3. To improve the shear stiffness, the honeycombs of the two plates 3, 5 can also support themselves on each other transversely to the respective plate plane.

In the shown examples the carrier 2 is designed as intermediate bottom which is arranged in the interior of the housing 17. Alternatively, the carrier can also be an end bottom of the housing 17. Here, the carrier 2, i.e. the respective bottom is enclosed on the edge-side by a shell 18 of the housing 17. For a better connection to the shell 18, the carrier 2 can have a collar-like circumference 19 on its edge located outside standing away from the carrier 2, which bears against the shell 18. In the examples, the circumference 19 stands away from the carrier 2 on the same side on which the plate 3 is also arranged.

Practically, the plate 3 is thus configured as composite plate which is assembled from a plurality of individual plates. Particularly advantageous here is the use of a humped composite plate which is assembled from at least two humped plates 3. Practically, this is carried out such that the humps 11 of the first humped plate 3 with their face ends 14 areally bear against the baseplate 12 of the second humped plate 3 and are fastened thereto if required, namely on its front side, in each case between adjacent humps 11 of the second humped plate 3. Conversely, the humps 11 of the second humped plate 3 come to bear with their face ends 14 against the front side of the baseplate 12 of the first humped plate 3 at the same time and can be fastened there. Because of this, a particularly stiff honeycomb structure W is created. In order to further increase the stiffness of the honeycomb structure W, the humps 11 can be dimensioned and spaced from one another so that the humps 11 of the first humped plate 3 via its shells 15 come to bear against the humps 11 of the second humped plate 3 and because of this make possible an intensive support in the shearing direction.

Figure 3:
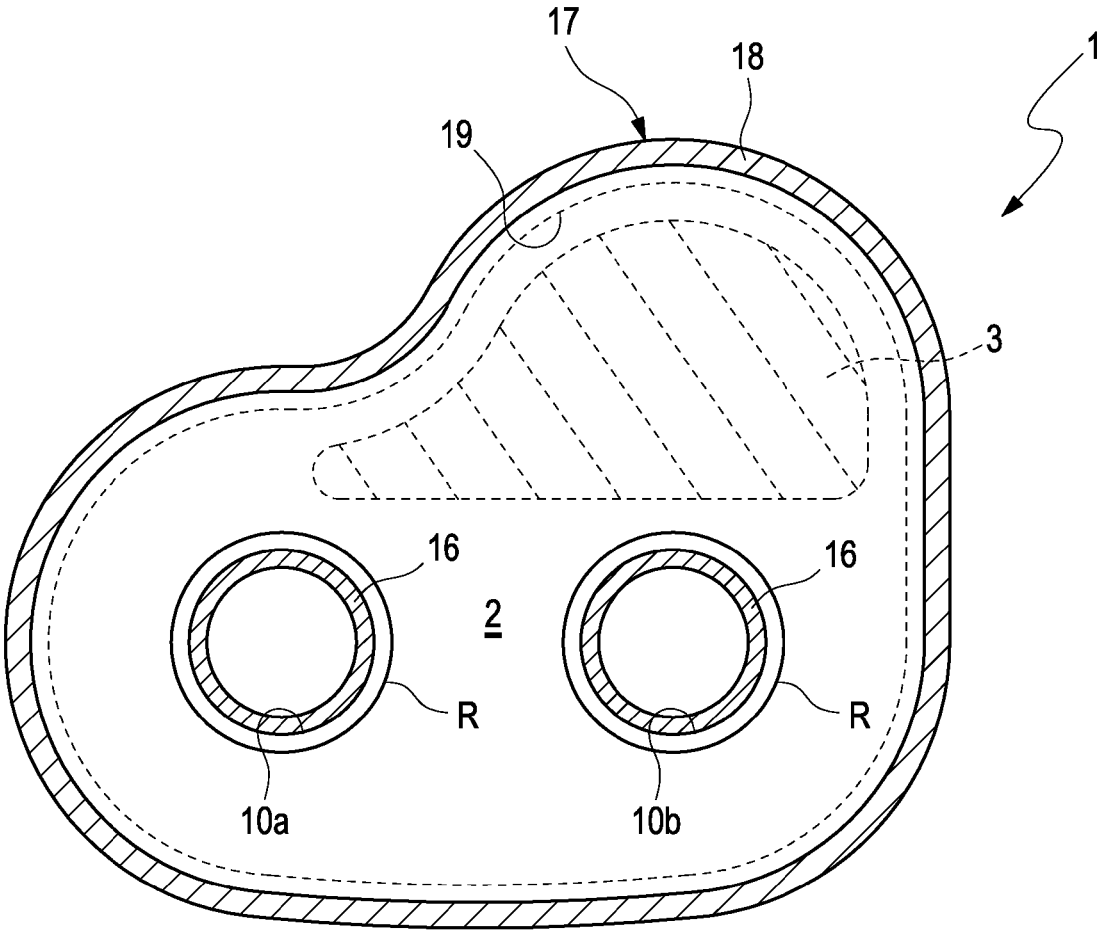
FIG. 3 a partially cut top view of a component according to the invention in the manner of a silencer according to FIG. 1.

FIG. 3 shows a component 1 in the form of a silencer according to FIG. 1 in top view. Here, the component 1 comprises the carrier 2 configured as end bottom or as intermediate bottom, which comprises two openings 10*a*, 10*b*. These are substantially arranged in the lower region of the carrier 2 according to FIG. 3. Above the two openings 10*a*, 10*b* the plate 3 with the honeycomb structure W is arranged. The plate 3 in this case is designed partially analogously to the curved shape of the component 1 or of the carrier 2.

In summary the invention has a plurality of advantages. On the one hand it makes possible a simple and cost-effective increase of the structural stiffness and strength of components. On the other hand, the wall thickness of the carrier 2 can also be reduced while maintaining a desired structural stiffness or component strength.

LIST OF REFERENCE CHARACTERS

1 Component in the form of a silencer
2 Carrier
3 Plate with honeycomb structure
3*a*, 3*b* Position of a plate
3' Connecting element
4 Connection
5 Plate
6 Connection
10*a*, 10*b* Opening
R Edge
W Honeycomb structure

The invention claimed is:

1. A component for motor vehicles, in particular in exhaust systems or in independent heaters, comprising a carrier and a plate for increasing the structural stiffness of at least one part of the carrier, wherein the plate at least partially comprises a honeycomb structure and wherein the plate is fixed to the carrier via at least one connection, and wherein at least one cavity is formed between the plate and the carrier.

2. The component according to claim 1, wherein the carrier comprises at least one opening for passing through an exhaust pipe wherein the plate is fixed on the carrier spaced from the at least one opening.

3. The component according to claim 1, wherein the carrier comprises an edge enclosing the respective opening and standing away from the carrier in a projecting manner.

4. The component according to claim 1, wherein the plate is of a multiple layer design.

5. The component according to claim 1, wherein the connection is formed in a non-positive and/or materially joined manner.

6. The component according to claim 1, wherein
the connection is designed as at least one of glued, soldered, welded, riveted, vulcanised and/or screwed connection.

7. The component according to claim 1, wherein the plate in the region of the honeycomb structure is configured as humped plate which comprises a baseplate, from which the humps stand out, each of which comprise a face end spaced from the baseplate and a shell connecting the face end to the baseplate, wherein the respective shell encloses a hollow space delimited by the face end, which forms a honeycomb of the honeycomb structure.

8. The component according to claim 7, wherein the shells are arranged at an angle of more than about 0 degrees and less than about 90 degrees relative to a surface of the carrier.

9. The component according to claim 1, wherein the plate at least in the region of the honeycomb structure is configured as composite plate.

10. The component according to claim 9, wherein the composite plate is configured as humped composite plate.

11. The component according to claim 10, wherein the humps of the humped plate support themselves laterally on the humps of the other humped plate via the respective shell.

12. A method for producing a component, in particular according to claim 1, comprising fixing the plate on at least a part of the carrier, and providing the plate at least partially with a honeycomb structure.

13. The method according to claim 12, wherein the plate is connected to the carrier in a non-positive and/or materially joined manner, in particular at least one of glued, soldered, welded, riveted, connected by means of vulcanising and/or screwed to the carrier.

14. A use of a component according to claim 1 in a motor vehicle, in particular in an exhaust line and/or in an independent heater of the motor vehicle.

15. A silencer of an exhaust system or independent heater for a motor vehicle, the exhaust system or independent heater including a housing, comprising a component according to claim 1 wherein the carrier forms one of an end bottom or an intermediate bottom of the housing and on the edge-side is enclosed by a shell of the housing.

* * * * *